US007004288B2

(12) United States Patent
Araki et al.

(10) Patent No.: US 7,004,288 B2
(45) Date of Patent: Feb. 28, 2006

(54) LIFT APPARATUS

(75) Inventors: Toshiyuki Araki, Nishisonogi-Gun (JP); Junichi Morishita, Nagasaki (JP); Tsuyoshi Kawazoe, Nishisonogi-Gun (JP)

(73) Assignee: Ryo Keiso Ltd., Nagasaki (JP)

( * ) Notice: Subject to any disclaimer, the term of this patent is extended or adjusted under 35 U.S.C. 154(b) by 506 days.

(21) Appl. No.: 10/202,011

(22) Filed: Jul. 25, 2002

(65) Prior Publication Data

US 2003/0031546 A1 Feb. 13, 2003

(30) Foreign Application Priority Data

Aug. 8, 2001 (JP) ..... 2001-241150

(51) Int. Cl.
*E06C 7/16* (2006.01)

(52) U.S. Cl. ..... 182/103; 182/148

(58) Field of Classification Search ..... 414/618, 414/592, 281, 564, 589; 212/199, 202; 182/2.5, 182/20, 69.6, 82, 83, 84, 101–103, 115, 119, 182/121, 228.5; 187/241, 243, 255, 482, 187/1, 240, 270

See application file for complete search history.

(56) References Cited

U.S. PATENT DOCUMENTS 651,665 A * 6/1900 Johns ..... 182/102
2,714,434 A * 8/1955 Peterson ..... 182/102
3,343,692 A * 9/1967 Arnot ..... 414/281
4,450,935 A * 5/1984 Gustavus ..... 182/121
4,793,437 A * 12/1988 Hanthorn ..... 182/102
6,311,800 B1 * 11/2001 St-Germain et al. ..... 182/146

* cited by examiner

*Primary Examiner*—Dean J. Kramer
(74) *Attorney, Agent, or Firm*—Jacobson Holman PLLC

(57) ABSTRACT

The invention provides a lift apparatus for use with a ladder having two spaced upright stringers and a plurality of horizontal rungs bridging the stringers and spaced at a distance vertically from one another. The lift apparatus comprises a frame, a prime mover mounted on the frame and having a rotatable output shaft, at least one pair of sprocket systems space apart vertically from each other. At least one of the sprocket systems is operatively coupled with the output shaft of the prime mover. Endless driving force transmitting mechanism can pass around the pair of the sprocket systems. Controller is provided for controlling the prime mover in such a manner as to selectively rotate the output shaft thereof in forward or reverse direction, or stop it. Operating mechanism is provided for causing a plurality of gripper elements to be engaged with the corresponding rungs of the ladder. The gripper elements are carried by the endless driving force transmitting mechanism and spaced at a distance substantially corresponding to that of the rungs of the ladder. A platform is secured to the frame for supporting an operator thereon.

4 Claims, 6 Drawing Sheets

LIFT APPARATUS

BACKGROUND OF THE INVENTION

1. Field of the Invention

The present invention relates to a lift apparatus, and in particular, a lift apparatus adapted to carry a person up or down along an upright ladder provided in conjunction with a steep surface.

2. Description of the Related Art

It is well known that ladders have been commonly used in order to carry a person or worker up or down along a building wall or other structure.

Recently, attention has been focused on a wind power generation systems as a clean energy source. A windmill for use in wind power generation includes a tower portion and an impeller portion attached to the top of the tower portion. A ladder is provided on the inside of the tower portion as extending vertically from the ground to the wind impeller portion for purpose of maintenance of the windmill.

With large-scaling of a windmill, the ladders can be as high as 60 m and it has been difficult for person to climb or descend such ladders by himself, from the viewpoint of common human physical capabilities.

Under the circumstances, a lift, gondola or elevator apparatus, etc., has been widely used as means for carrying a person up or down along the wall of the tall building.

However, neither of these apparatus can allow the person to climb or descend in the event of failure thereof. On the other hand, in order to install the apparatus on the windmill structure having the existing ladder, removal of the ladder from the windmill structure is often required due to limited space availability.

SUMMARY OF THE INVENTION

It is therefore an object of the present invention to provide a unique lift apparatus capable of climbing or descending the existing ladder and also enabling the operator to manually operate the lift apparatus in such a manner as to carry it up or down along the ladder in the event of failure thereof.

The present invention achieves this object by providing a lift apparatus for use with a ladder having two spaced upright stringers and a plurality of horizontal rungs bridging the stringers and spaced at a distance vertically from one another, the improvement comprising: a frame; a prime mover mounted on the frame and having a rotatable output shaft; at least one pair of sprocket systems space apart vertically from each other, at least one of the sprocket systems being operatively coupled with the output shaft of the prime mover; endless driving force transmitting means passing around the pair of the sprocket systems; controller means for controlling the prime mover in such a manner as to selectively rotate the output shaft thereof in forward or reverse direction, or stop it; an operating mechanism for causing a plurality of gripper elements to be engaged with the corresponding rungs of the ladder, said gripper elements being carried by said endless driving force transmitting means and spaced at a distance substantially corresponding to that of the rungs of the ladder; and a platform secured to the frame for supporting an operator thereon.

In accordance with the lift apparatus of the present invention, the lift apparatus is attached to the ladder. For example, the controller is selectively operated so that the output shaft of the prime mover may be rotated in the forward direction. The rotation of the output prime mover causes rotation of the sprocket system attached to the output thereof, which in turn allows the endless driving force transmitting means to be rotate. Then, as the endless driving force transmitting means is rotated, the gripper elements carried by the endless driving force transmitting means can releasably engage the corresponding rungs of the ladder in such a manner as to climb or descend along the ladder depending on the direction of rotation of the output prime mover shaft. In the event of failure or malfunction of the lift apparatus, the operator can climb or descend the ladders by himself.

In the present invention, it is preferable that each of the gripper elements comprises: a load supporting plate including an recessed engaging portion capable of engaging the top surface of the rung and mounted for pivotal movement relative to said endless driving force transmitting means; biasing means operable to pivot the load supporting plate relative to the endless driving force transmitting means in such a manner as to move the recessed portion thereof upwardly away from the top surface of the rung; and a cam follower attached to the load supporting plate and also the operating mechanism comprises a cam operable to engage the cam follower as at least one of the gripper elements confronts the ladder so as to pivot the load supporting plate relative to the endless driving force transmitting means against a biasing force from said biasing means in order to place the recessed portion of the load supporting plate into engagement with the top of the rung of the ladder.

Additionally, each of the load supporting plate further preferably includes a gripping finger pivotally attached thereto, the gripping finger being shaped so as to engage the side surface of the corresponding rung remote from the lift apparatus when each of the gripper elements confronts the ladder.

The above and other objects and features of the present invention will be apparent from the following description made with reference to the accompanying drawings showing preferred embodiments of the present invention.

DETAILED DESCRIPTION OF THE PREFERRED EMBODIMENTS

Several embodiments of the present invention will now be described hereinbelow with reference to the accompanying drawings. The embodiments of the present invention provide a self-propelled lift apparatus for use with a ladder, which can carry a person or worker up or down the ladder and comprises two parallel, vertically extending side rails or stringers SR and a plurality of cross members or rungs extending horizontally between the stringers SR.

Figure 1:
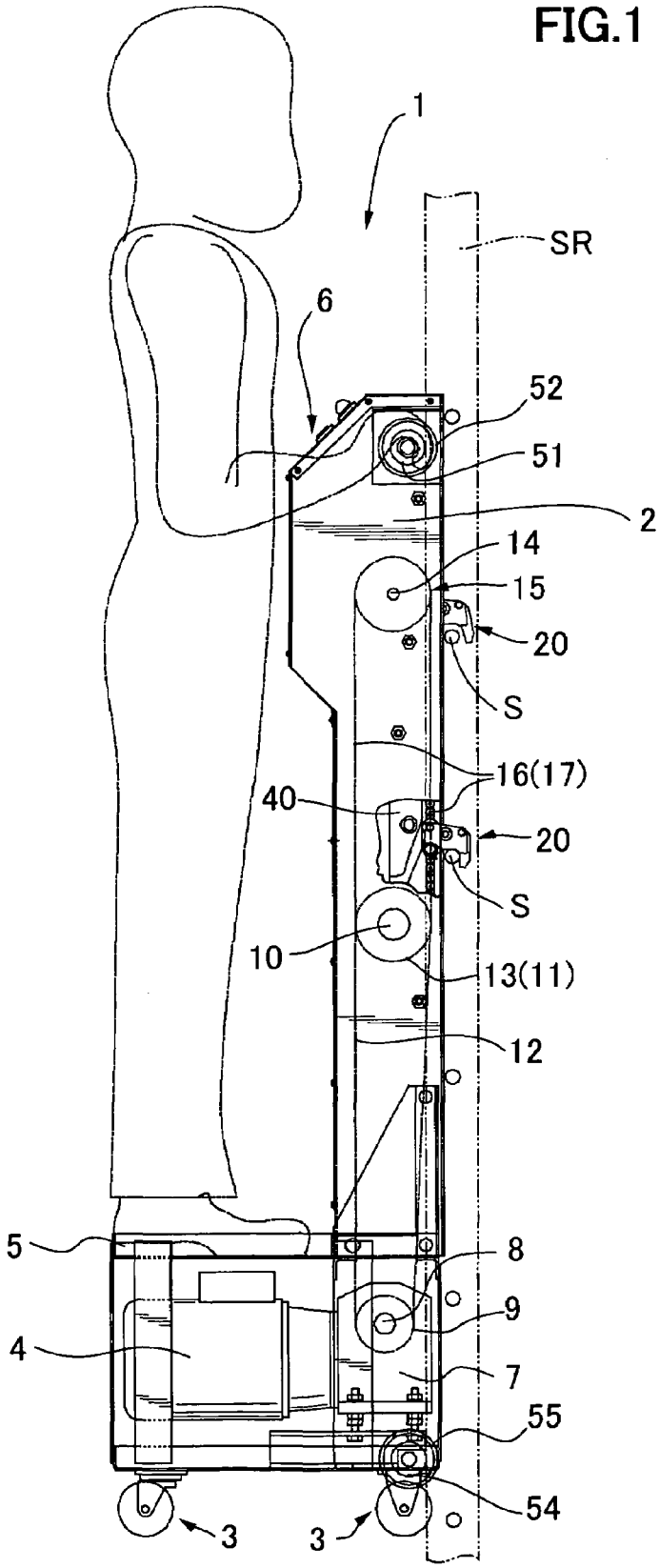
FIG. 1 is a side elevational view of a lift apparatus for use with a ladder in accordance with one embodiment of the present invention.
Figure 2:
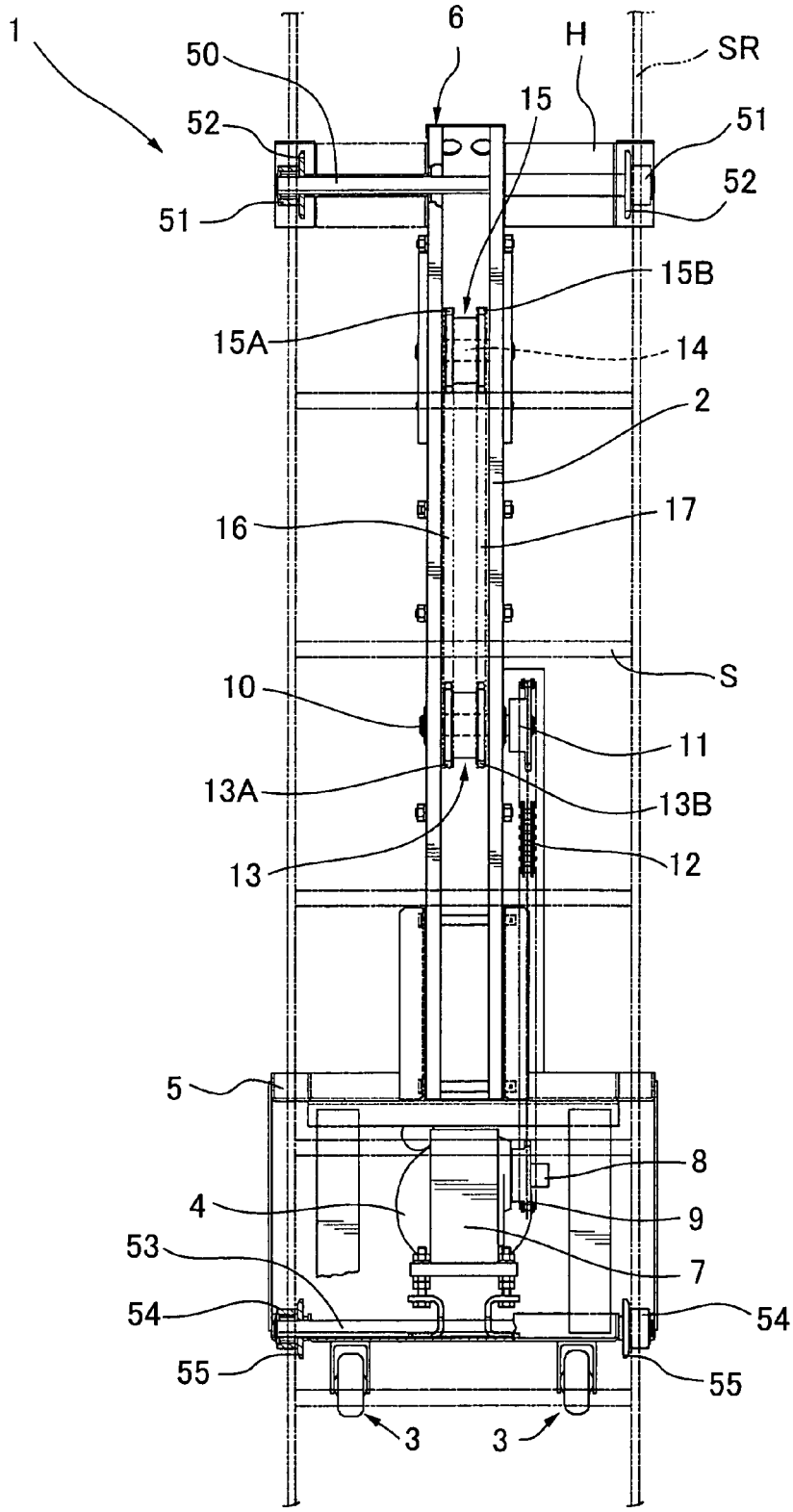
FIG. 2 is a rear view of the lift apparatus shown in FIG. 1.

Referring to FIGS. 1 and 2, there is shown an embodiment of the lift apparatus according to the present invention, indicated generally by reference numeral 1.

The lift apparatus 1 includes a lift frame 2 which is provided at its bottom with four casters 3 so that the lift 1 can be easily conveyed.

A prime mover in the form of a motor 4 is mounted on the lift frame 2 above the casters 3, and a platform or floor 5 on which the worker can step is mounted on the lift frame 2 above the motor 4. Controller 6 is provided on an upper part of the lift frame 2 for and can be operated to selectively drive the motor in a forward or reverse direction, or stop it. The controller 6 has handles H projecting outwardly of the opposite sides thereof.

The motor 4 has its output shaft (not shown) which drivingly coupled to a gear train or reduction gearing 7 which in turn has its output shaft 8 to which is fixedly attached a sprocket wheel or a first sprocket system 9. Rotatably supported by the frame 2 above the first sprocket 9 is a first shaft 10 having a second sprocket 11 fixedly attached thereto. Driving force transmitting means in the form of a first endless chain 12 is passed around the first and second sprockets 9 and 11.

The first shaft 10 also has attached thereto a dual sprocket or a third sprocket system 13 fixedly attached thereto and placed midway transversely of the frame. As shown, the third sprocket system 13 comprises two sprocket wheels 13A and 13B. Rotatably supported by the frame 2 above the third sprocket 13 is a second shaft 14 having a dual sprocket or fourth sprocket system 15 fixedly attached thereto. The fourth sprocket system comprises sprocket wheels 15A and 15B. Driving force transmitting means in the form of second and third endless chains 16, 17 are passed around the sprocket wheels 13A and 13B of the third sprocket 13 and around the sprocket wheels 15A and 15B of the fourth sprocket 15, respectively.

Thus, as the motor 4 is rotated in the forward direction by operating the controller device 6, all the sprocket systems 9, 11, 13 and 15 are driven in a clockwise direction as viewed in FIG. 1 under the action a driving force from of the output shaft of the motor 4 via the reduction gearing 7 and endless chains 12, 16 and 17 so that the lift apparatus can be elevated along the ladder 1, as described in detail hereinafter. To the contrary, as the motor 4 is rotated in the reverse direction, all the sprocket systems 9, 11, 13 and 15 are driven in a counterclockwise direction as viewed in FIG. 1, thereby causing the lift apparatus 1 to descend along the ladder.

The lift apparatus 1 also comprises a gripper operating mechanism operable to provide positive engagement with the rungs S of the ladder in such a manner as to selectively cause to the lift apparatus to ascend or descend the rung S.

Figure 3:
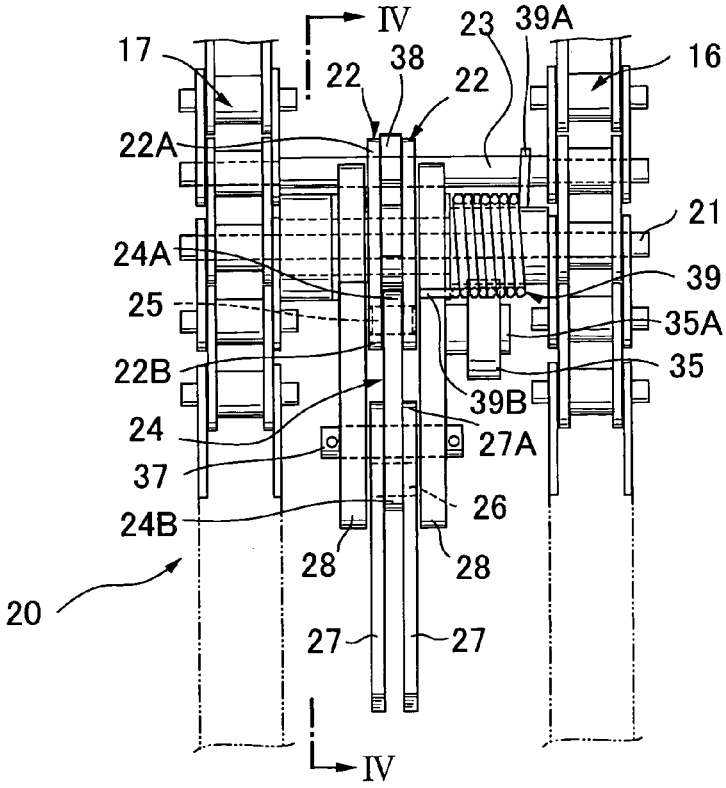
FIG. 3 is an enlarged view of a latch mechanism for use in the lift apparatus, showing the latch mechanism in a position wherein the latch is biased by a coiled spring.
Figure 4:
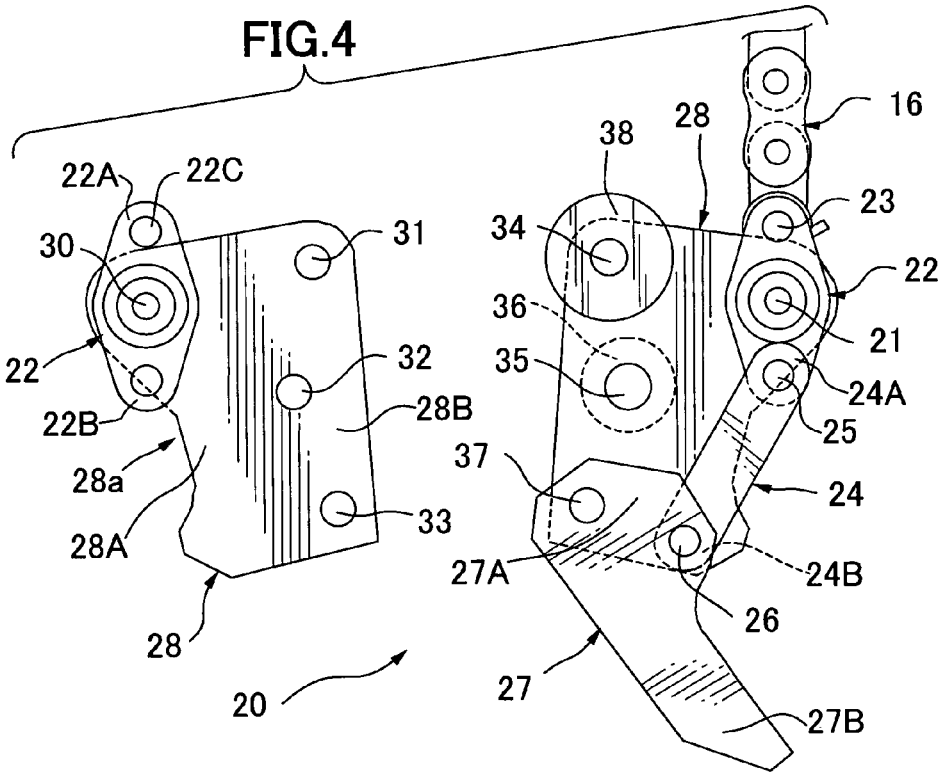
FIG. 4 is a partially exploded side elevational view of one of the gripper elements taken on line IV—IV in FIG. 3.

The gripper operational mechanism is associated with a plurality of gripper elements generally indicated at 20 carried by the endless chains 16 and 17 and spaced apart by the same distance or pitch as that of the rungs S of the ladder along which the lift 1 is elevated or lowered. The spacing between the gripper elements 20 (that is, the center-to-center spacing of the shafts 21 of the gripping elements 20 that define their respective center of rotation) can substantially correspond to the spacing between the rungs S (the spacing between the longitudinal axes thereof) of the ladder. More particularly, it is preferable that the spacing between these rungs (spacing between the longitudinal axes thereof) of the ladder is slightly shorter than the spacing between the gripping members 20 (the center-to-center spacing of the shafts 21 of the gripping members 20) in order to efficiently transmit the driving force from the motor 4 to the rungs S of the ladder, As shown in FIG. 3 and FIG. 4, each of the gripping elements 20 is provided its respective one end with a shaft 21 defining its respective center of rotation. A pair of spaced apart links 22 and 22 are rotatably attached to the rotation shafts 21. Each of the links 22 has first and second end portions 22A and 22B. The first end portion 22A of the link 22 has formed therethrough a hole 22C through which a stopper shaft 23 extends and the opposite end portions of the stopper shaft 23 are attached to the endless chains 16 and 17.

A link arm 24 is provided as shown and has a first end portion 24A which is disposed between the second end portions 22B of the links 22. The second end portion 22B of the link 22 and the first end portion 24A of the link arm 24 are rotatably attached to a pin 25 extending therethrough.

Gripping fingers or dogs 27 are disposed on the opposite sides of the second end portion 24B of each of the link arm 24, that is, adjacent to the opposite outer sides of the second end portion 24B. Each of the dogs 27 is in the form of an angulated member and, more specifically is generally "L" or "dog-leg" shaped plate member as can be seen in FIG. 4. Each of the gripping fingers 27 includes a first portion 27A and a second portion 27B extending approximately orthogonal to the corresponding first portion 27A. The respective first portions 27A of the pairs of gripping fingers 27 and 27 and the second end portion 24B of the link arm 24 are rotatably supported by the gripping finger shaft 26.

A pair of load supporting plates 28 are disposed outward of the first portion 27A of the respective gripping fingers 27, that is, adjacent to the outer sides of the respective first portions 27A. Each of the load supporting plates 28 includes a first side or outward portion 28A and a second side or inward portion 28B. The outward portion 28A of each of the load supporting plates 28 includes a recessed engaging edge portion 28*a* which can engage the top surface of the corresponding rungs S of the ladder and which can be generally "C"-shaped as can best seen in FIG. 4.

As can be seen in FIG. 4, each of the load supporting plates 28 includes a first hole 30 formed therethrough at the outward portion 28A above the recessed engagement edge portion 28*a*, a second hole 31 formed therethrough at the inward portion 28B approximately at the same level as that of the corresponding first hole 30, a third hole 32 formed therethrough at the inward portion 28B slightly inward and downward of the corresponding second hole 31, and a fourth hole 33 formed therethrough at the inward portion 28B slightly outward and downward of the corresponding third hole 32.

The respective first holes 30 of the load supporting plates 28 are coupled to the rotation shaft 21. Also, a cam roller shaft 34 extends between the second holes 31 and 31 of the pair of load supporting plates 28, and an auxiliary cam roller shaft 35 extends between the third holes 32 and 32. As viewed in FIG. 4, the right end portion of the auxiliary cam roller shaft 35 protrudes from the load supporting plates 28, and the auxiliary cam roller 36 is rotatably attached to the protrusion end portion 35A of the auxiliary cam roller shaft 35. Further, a pivot shaft 37 extends between the fourth holes 33 and 33 of the pair of load supporting plates 28 so that the pivot shaft 37 passes through the first portion 27A and 27A of a pair of gripping fingers 27.

A cam follower in the form of a cam roller 38 is rotatably attached to the cam roller shaft 34 between the pair of load supporting plates 28 and 28. As viewed in FIG. 3, biasing means in the form of a coiled spring 39 is disposed around the rotation shaft 21 outward of the right side load supporting plate 28. One end portion 39A of the coiled spring 39 is brought into contact with the stopper shaft 23 and the other end portion 39B thereof is fixed at the right side load supporting plate 28, as viewed in FIG. 3, so that the coiled spring 39 may cause the load supporting plate 28 to pivot around the rotation shaft 21 inwardly of a loop that is defined by the chains 16 and 17, that is, so that as viewed in FIG. 4, the load supporting plate 28 is pivoted in the clockwise direction.

The lift apparatus 1 includes a cam 40 that, when the gripper operating mechanism or some of the gripping elements 20 confront the ladder, causes the load supporting plate 28 to pivot around the rotation shaft 21 against the biasing force of the coiled spring 39 and causes the edge portion 28*a* of the load supporting plate 28 to be engaged with the upper surface of the rung S.

Figure 5:
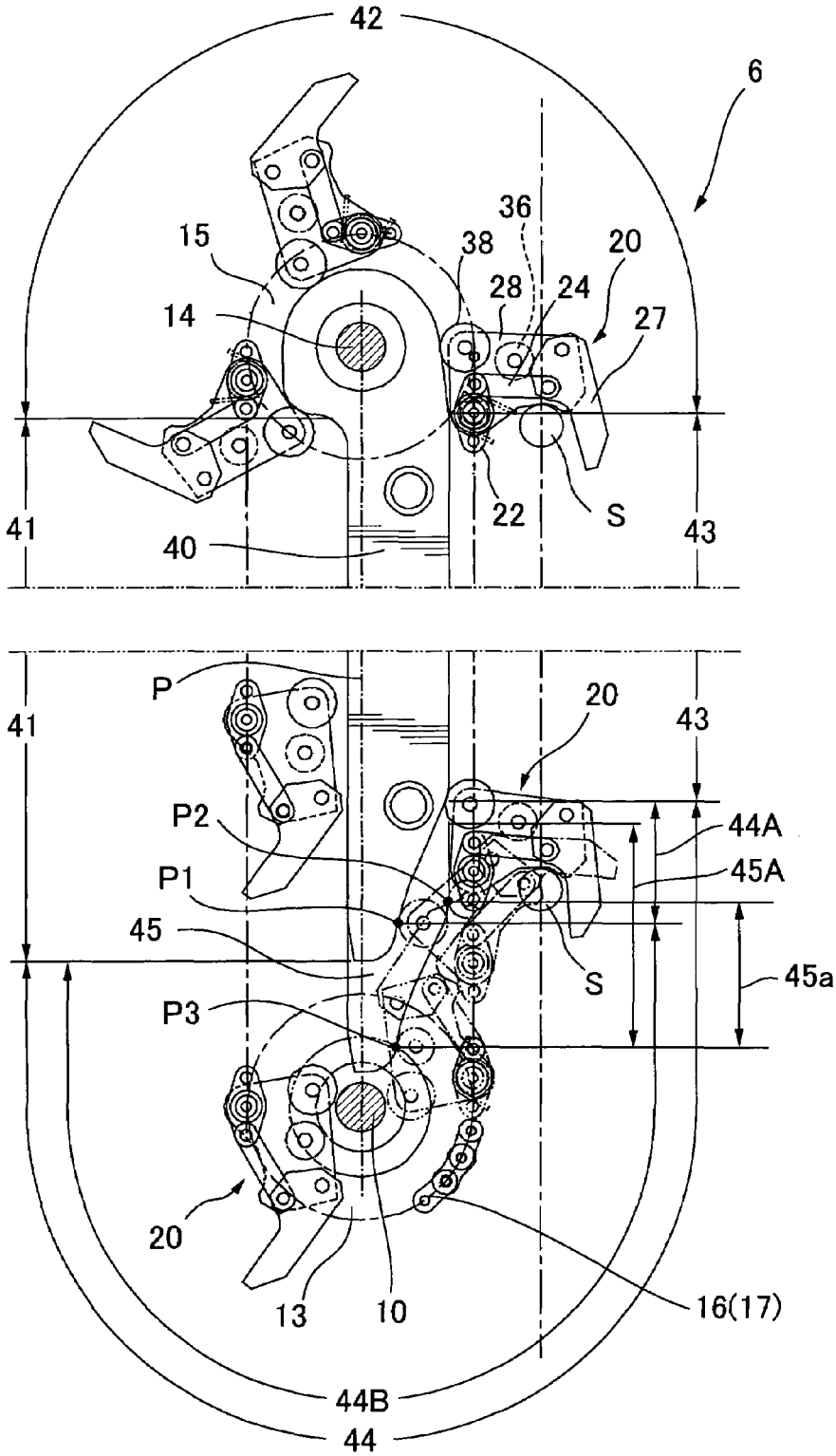
FIG. 5 is a partial side elevational view of the lift apparatus, showing an operational relationship between the gripper elements and cam of the gripper operating mechanism.

As can be readily appreciated from FIG. 5, the cam 40 generally extends between the third sprocket system 13 and the fourth sprocket system 15 along the channel of the cam roller 38 of the gripping member 20 attached to the chains 16 and 17.

As viewed in FIG. 5, the cam 40 includes the first non-contact face 41 extending from a position slightly above the third sprocket system 13 to roughly downward of the fourth sprocket system 15 in an inner area positioned at the operator side or inwardly thereof from a virtual vertical plane P along which the chains 16 and 17 extend so as to pass through the axial line of the rotation center of the first shaft 10 and the axial line of the rotation center of the second shaft 14. The first non-contact face 41 is positioned so that it is not brought into contact with the cam roller 38 of the gripping member 20.

Also, as viewed in FIG. 5, the cam 40 includes a first intermediate contact face 42 that passes around the second shaft 14 from the upper end of the non-contact face 41 and extends slightly downward of the fourth sprocket system 15 in an outer area of the chains 16 and 17 that are positioned at the ladder side from the imaginary vertical plane P and outwardly of the vertical imaginary plane P, and the first intermediate contact face 42 is brought into contact with the cam roller 38 of the gripping member 20 and is positioned so that the distance from the first intermediate contact face 42 and the rotation shaft 21 decreases gradually from an end in the inner area of the chains 16 and 17 to an end in the outer area thereof.

As viewed in FIG. 5, the cam 40 also includes a contact face 43 extending from the end of the first intermediate contact face 42 in the outer area of the chains 16 and 17 to a position slightly above the third sprocket 13, and the contact face 43 is brought into contact with the cam roller 38 of the gripping member 20 and is positioned so that the engagement edge portion 28*a* of the load supporting plate 28 is engaged with the upper surface of the rung S.

Further, as viewed in FIG. 5, the cam 40 has a lower face 44 extending from the lower end of the contact face 43 to the lower end of the non-contact face 41. The lower face 44 is comprised of a second intermediate contact face 44A positioned so that, as viewed in FIG. 5, the distance between the lower face 44 to the rotation shaft 21 increases gradually from the lower end of the contact face 43 to a first point P1, and a second non-contact face 44B positioned so that it is not brought into contact with the cam roller 38.

The gripper operating mechanism also includes an auxiliary cam 45 having an auxiliary cam surface 45A extending in such a manner that, as viewed in FIG. 5, the distance between the auxiliary cam surface 45A and the rotation shaft 21 increases gradually from a position slightly below the lower end of the contact face 43 of the cam 40 toward the first shaft 10 along the channel of the auxiliary cam roller 36. The auxiliary cam surface 45A has a third intermediate contact face 45*a* extending between a second point P2 and a third point P3, with which the auxiliary cam roller 36 is brought into contact.

As can best seen in FIG. 2, the lift apparatus 1 additionally can comprise guide means engaging the opposite stringers SR for guiding the lift apparatus along the ladder.

In the embodiment as shown, the guiding means comprises an upper guide shaft 50 extending through a bore in the handle H and attached to the upper part of the lift frame 2, a pair of upper guide rollers 51 rotatably mounted on the opposite ends of the upper guide shaft 50, a ring-shaped stopper 52 positioned adjacent to the inner end surface of the respective guide rollers 51 and attached to the upper guide shaft 50, a lower guide shaft 53 extending parallel to the upper guide shaft 50 and attached to the lower part of the lift frame 2, a pair of lower guide rollers 54 rotatably mounted on the opposite ends of the lower guide shaft 53 and a ring-shaped stopper 55 positioned adjacent to the inner end surface of the respective guide rollers 54 and attached to the lower guide shaft 53.

Operation of the lift apparatus according to the embodiment s described above will be described below.

At first, the lift apparatus 1 is attached to the ladder along which the lift 1 is to climb or descend by using the gripper operating mechanism associated with the certain load supporting plates 28 having the cam rollers 38 in contact with the contact face 43 of the cam 40 as shown. More specifically, with the engagement edge portion 28*a* of the load supporting plate 28 facing downwardly and the second portion 27B of the dogs 27 oriented generally vertically downwardly, the gripper elements 20 are arranged such that the engagement edge portions 28*a* engage the upper surfaces of the corresponding rungs S of the ladder and also the second portion 27B of the dogs 27 engage the side surfaces of the rungs S that are positioned remote from the lift apparatus 1. Such arrangement may be accomplished on the basis of a principle established due to the fact that the cam rollers 38 engage the contact cam face 43 that will become apparent hereinafter.

As can be seen in FIG. 2, when attaching the gripping member 20 to a ladder, preferably, the guide rollers 51 and 54 are brought into contact with the front side (the side facing an operator's side) of the stringers SR of the ladder and are disposed so that the outer sides of the stoppers 52 and 55 are positioned adjacent to the inner side of the stringers SR of the ladder.

When elevating the lift apparatus 1 along the ladder, the operator steps on the platform 5 and operates the controller 6 to rotate the motor 4 in the forward direction so that the endless chains 16 and 17 are driven in the clockwise direction as viewed in FIG. 1 and FIG. 5 in the manner as described above. During operation of the lift apparatus 1, the operator is able to grasp the handle H for safety.

As can be readily appreciated from FIG. 5, in the case when some of the gripper elements 20 confront the first non-contact face 41 of the cam 40, the cam roller 38 is not brought into contact with the first non-contact face 41. Therefore, the load supporting plates 28 and 28 of the gripping members 20 are caused to pivot around the rotation shaft 21 in the counterclockwise direction as viewed in FIG. 1 and FIG. 5 under the action of the biasing force of the coiled spring 39. It should be noted that larger space is available due to that fact that the gripper elements 20 do not interfere with the operator. This is because the first non-contact face 41 is positioned away from the operator, that is, the first non-contact face 41 is recessed as shown and almost the entirety of the gripping member 20 is accommodated inwardly of a loop defined by the chains 16 and 17 with the aid of the coiled spring 39. In other words, if larger boarding space can be secured, the gripping member 20 is allowed to be positioned outward of the loop of the chains 16 and 17 and the provision of the first non-contact surface on the cam 40 do not necessarily required.

It also should be noted that counterclockwise pivotal movement of the load supporting plate 28 around the rotation shaft 21 by the action of the biasing force of the coiled spring 39 is stopped by means of the load supporting plate 28 which is brought into contact with the stopper shaft 23. Of course, the geometry of each gripper element 20 may be determined so that, when the cam roller 38 confronts to the first non-contact face 41 of the cam 40, the gripping member 20 is not brought into contact with the first non-contacting plate 41.

The gripping member 20 is then moved upward by the endless chains 16 and 17 as viewed in FIG. 1 and FIG. 5. When the cam roller 38 is brought into contact with the first intermediate contact face 42 of the cam 40 inwardly of the chains 16 and 17, the load supporting plates 28 and 28 are caused to pivot around the rotation shaft 21 against the biasing force of the coiled spring 39 as viewed in FIG. 1 and FIG. 5. The gripping fingers 27 rotatably attached to the pivot shafts 37 which are attached to the corresponding load supporting plates are also caused to pivot around the rotation shaft 21 in the clockwise direction by rotations of such load supporting plates 28 as viewed in FIG. 1 and FIG. 5. As a result, the link arm 24 in which the second end portion 24B is rotatably attached to the first portion 27A of the gripping finger 27 is also caused to pivot around the pin 25 in the clockwise direction as viewed in FIG. 1 and FIG. 5.

It also should be noted that the pair of the link, 22 and 22 are attached to the chains 16 and 17 at two points of the rotation shaft 21 and stopper shaft 23, the pair of links 22 is not substantially displaced with respect to the chains 16 and 17.

As described above, in view of the fact that the first intermediate contact face 42 is configured so that the distance between the intermediate contact face 42 and the rotation shaft 21 decreases gradually from the end inward of the chains 16 and 17 to the end outward thereof, the distance between the rotation shaft 21 and the cam roller shaft 34 of the cam roller 38 in the vertical direction with respect to the course of the chains 16 and 17 decreases gradually as the gripping member 20 is caused to move along the first intermediate contact face 42. Thus, the load supporting plates 28 and link arm 24 are caused to further rotate in the clockwise direction.

Next, when the gripping member 20 is further moved by the endless chains 16 and 17 and the cam roller 38 is brought into contact with the contact face 43, the load supporting plates 28 and link arm 24 are caused to further rotate in the clockwise direction. Finally, the engagement edge portion 28*a* of the load supporting plate 28 is oriented vertically downward and engages the upper surface of the corresponding ladder rung S. Then, the second portion 27B of the gripping member 27 is oriented generally vertically downward and engages the side surface of the ladder rung S which is remote from the lift apparatus 1.

With the gripping member 20 engaged with the ladder rung S, the distance between the endless chains 16 and 17 and the pivot shaft 37 is longer than the distance between the endless chains 16 and 17 and the gripping finger shaft 26 in the vertical direction with respect to the course of the endless chains 16 and 17. That is, the pivot shaft 37 is positioned outward of the gripping finger shaft 26 with respect to the course of the endless chains 16 and 17. Therefore, while the load supporting plate 28 is pressed by the cam roller 38 so that the engagement edge portion 28*a* of the load supporting plate 28 is engaged with the upper surface of the ladder rung S, the pivotal movement of the gripping finger 27 around the pivotal shaft 37 in the counterclockwise direction as viewed in FIG. 5 is prevented by means of the link arm 24 extending between the fixed links 22 and the gripping finger 26 with respect to the endless chains 16 and 17. That is, the gripping finger 27 can prevent the gripping member 20 from being disengaged from the ladder rung S.

Next, as the gripping member 20 is further moved by the endless chains 16 and 17 until the cam roller 38 reaches the second intermediate contact face 44A of the lower face 44 of the cam roller 38, the load supporting plates 28 are gradually re-directed in the counterclockwise direction around the rotation shaft 21 as viewed in FIG. 5 under the action of the biasing force of the coiled spring 39. Accordingly, the link arm 24 is also caused to gradually turn in the counterclockwise direction around the pin 25 as viewed in FIG. 5. As a result, the engagement edge portion 28*a* of the load supporting plate 28 and the second portion 27B of the gripping finger 27 are gradually moved away from the upper surface of the ladder rung S, that is, the side of the ladder rung S, which is farther from the lift apparatus 1, respectively.

It is understood from the gripping member 20 generally shown in dot and dash lines in FIG. 5 that when the cam roller 38 reaches the first point P1 of the second intermediate contact face 44A, the auxiliary cam roller 36 is brought into contact with the third intermediate contact face 45*a* of the auxiliary cam plane 45A at the second point P2. As the cam roller 38 passes through the first point P1 of the second intermediate contacting plate 44A, the cam roller 38 is not brought into contact with the cam 40, that is, the second non-contact face 44B of the lower face 44. On the other hand, the auxiliary cam roller 36 is not brought into contact with the third intermediate contact face 45*a* from the second point P2 through the third point P3, and counteracts the biasing force of the coiled spring 39, which tends to cause the load supporting plate 28 to pivot in the counterclockwise direction around the rotation shaft 21 as viewed in FIG. 5.

As the gripping member 20 moves past the position shown by the dot and dash lines in FIG. 5, that is, as the auxiliary cam roller 36 passes past the third point P3 of the third intermediate contact face 45*a*, the auxiliary cam roller 36 is not brought into contact with the auxiliary cam 45. Therefore, the load supporting plate 28 is caused to pivot around the load supporting plate 28 in the counterclockwise direction as viewed in FIG. 5 by the biasing force of the coil spring 39. As a result, the gripping member 20 assumes the same position as the position at which the corresponding gripping member 20 assumes with respect to the chains 16 and 17 when it confronts the first non-contact face 41 of the cam 40.

The gripping member 20 is further moved by the endless chains 16 and 17 and is returned to the position facing the first non-contact face 41 of the cam 40, which is the initial position. Subsequently, the above-described operation is repeated during the rotation of the motor 4 in the forward direction.

Thus, while the engagement edge portions 28*a* of the load supporting plates 28 of the respective gripping members 20 and the second portion 27B of the gripping finger 27 are engaged with the upper surface of the ladder rung S and the side of the ladder rung S, which is remote from the lift apparatus 1, the lift apparatus 1 can be moved upward relative to the ladder rung S since the chains 16 and 17 are driven in the clockwise direction as viewed in FIG. 1 and FIG. 5. Since the gripping member 20 is engaged one after another with ladder rungs S which are further upward thereof, the lift apparatus 1 can be moved up along the ladder. When the lift apparatus 1 reaches a predetermined level along the ladder, the motor 4 is stopped by operating the controller 6.

In order to move the lift apparatus down along the ladder, the motor 4 can be rotated in the reverse direction by operating the controller device 6.

During the downward movement of the lift apparatus 1, with the engagement edge portion 28*a* of the load supporting plate 28 of the respective gripping members 20 and the second portion 27B of the gripping finger 27 respectively engaged with the upper surface of the ladder rung S, that is, the side of the ladder rung S, which is remote from the lift apparatus 1, the chains 16 and 17 are driven in the counterclockwise direction as viewed in FIG. 1 and FIG. 5 so that the lift apparatus 1 can be moved down relative to the ladder rung S, and the gripping member 20 is engaged, one after another, with the ladder rungs S which are further downward thereof. In this way, the lift apparatus can be moved down along the ladder. As the lift apparatus 1 is moved down to a predetermined level along the ladder, the motor 4 is stopped by operating the controller 6.

Since operations of the lift apparatus 1 in the lowering motion are similar to those of the lift apparatus 1 in the above-described elevating motion except the rotation direction of the chains 16 and 17, repeated description thereof is omitted.

Figure 6:
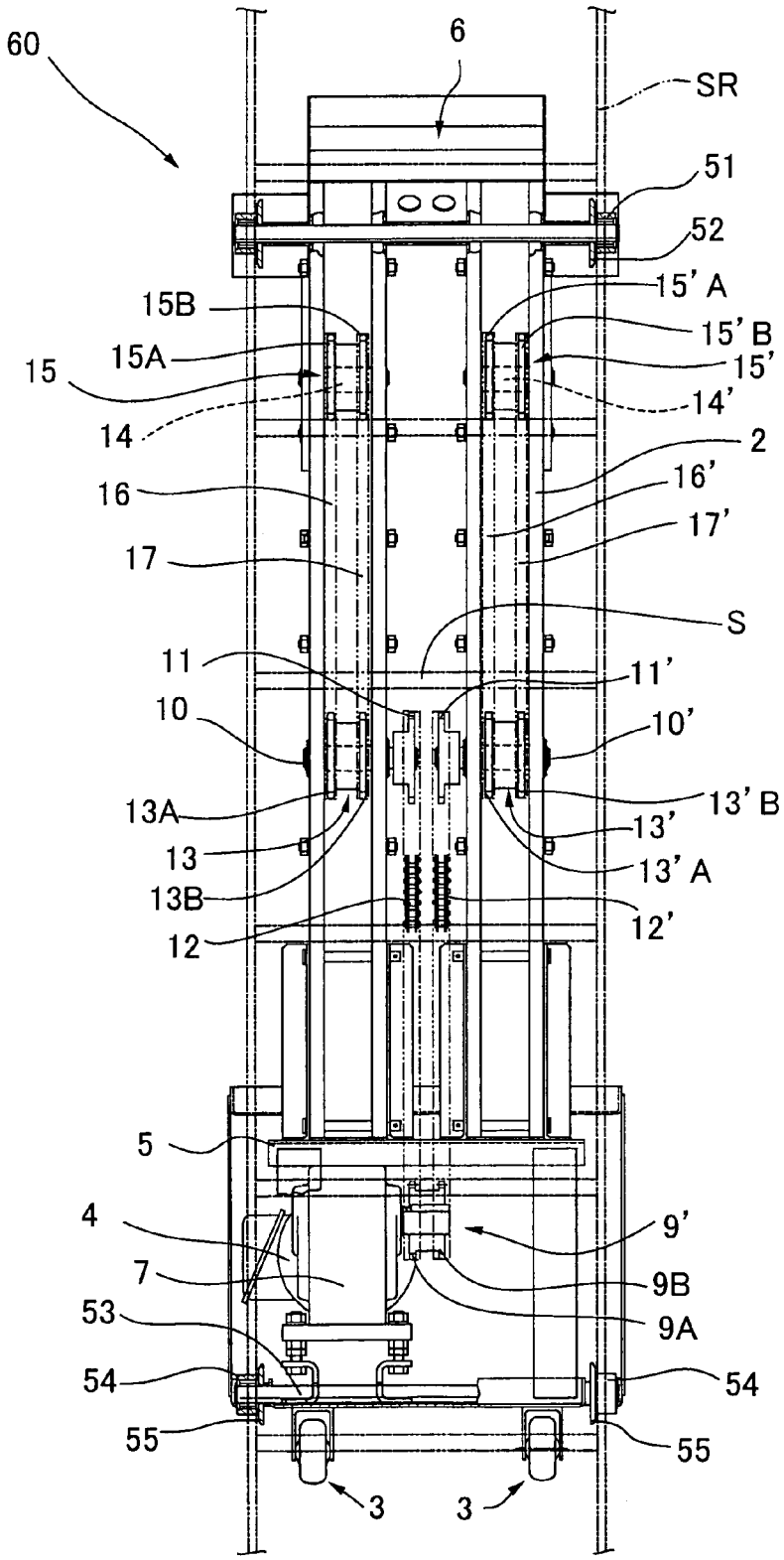
FIG. 6 is a rear view of a second embodiment of the lift apparatus of the invention.

FIG. 6 illustrates an alternative or second embodiment of the lift apparatus 1 as shown in FIGS. 1 to 5. In FIG. 6, those parts corresponding to the components of the lift apparatus 1 are identified with the same numerals.

In the alternative embodiment, the lift apparatus is generally shown at 60. The lift apparatus 60 is different from the lift apparatus 1 in that it employs two pairs of endless chains 16 and 17, and 16' and 17' unlike the lift 1 which uses one pair of the endless chains 16 and 17.

In order to insure proper synchronization between the two pairs of the endless chains 16 and 17, and 16' and 17', the lift apparatus 60 utilizes a dual sprocket system 9' attached to the output shaft (not shown) of the motor 4 that comprises sprocket wheels 9A and 9B. A pair of first shafts 10 and 10' are rotatably supported by the frame 2. Second sprockets 11 and 11' are attached to the shafts 10 and 10' at their ends, respectively. First endless chains 12 and 12' are passed around the sprocket wheel 9A of the dual sprocket system 9' and the second sprocket 11, and the sprocket wheel 9B of the dual sprocket system 9' and the second sprocket 11', respectively.

Dual sprocket systems 13 and 13' are fixedly attached to the first shafts 10 and 10', respectively. As shown, the dual sprocket systems 13 comprises two sprocket wheels 13A and 13A' and similarly, the dual sprocket systems 13' comprises two sprocket wheels 13B and 13B'. Positioned above the sprocket systems 13 and 13' are second shafts 14 and 14' which has dual sprocket systems 15 and 15' fixedly attached to the ends thereof, respectively. The dual sprocket systems 15, 15' comprise sprocket wheels 15A and 15B, and 15' and 15B'. Second and third endless chains 16 and 16', and 17 and 17' are passed around the sprocket wheel 13A and 13B, and 13A' and 13B' and the sprocket wheel 15A and 15B, and 15A' and 15B', respectively.

In accordance with the second embodiment arranged as illustrated and described, therefore, the dual sprocket system 9' is driven via the output motor shaft (not shown), which will drive the second sprockets 11 and 11' operatively coupled via the first endless chains 12 and 12' with the sprocket wheels 9A and 9B of the dual sprocket system 9, respectively. Driving force from each of the second sprockets 11 and 11' is transmitted to the associated dual sprocket systems 13 and 13' via the first shafts 10 and 10', respectively, which will result in the synchronous movement of the endless chains 16 and 17, and 16' and 17'

Of course, it suffices that the gripping members 20 which are attached to the endless chains 16 and 17, and 16' and 17' engage the corresponding rungs S of the ladder in the manner as described above. In this case, it is to be understood that the synchronous movement of the pairs of the endless chains 16 and 17, and 16' and 17' is not necessarily required.

Figure 7:
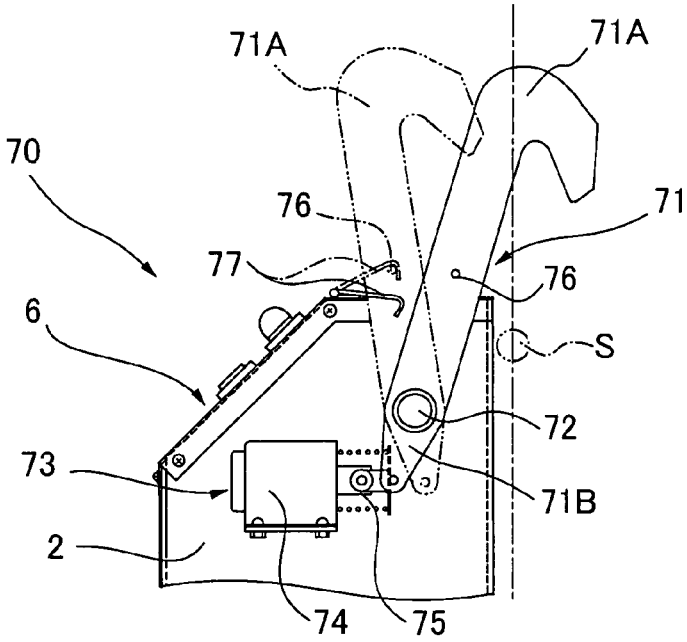
FIG. 7 is a partly enlarged side elevational view of a third embodiment of the lift apparatus of the invention.
Figure 8:
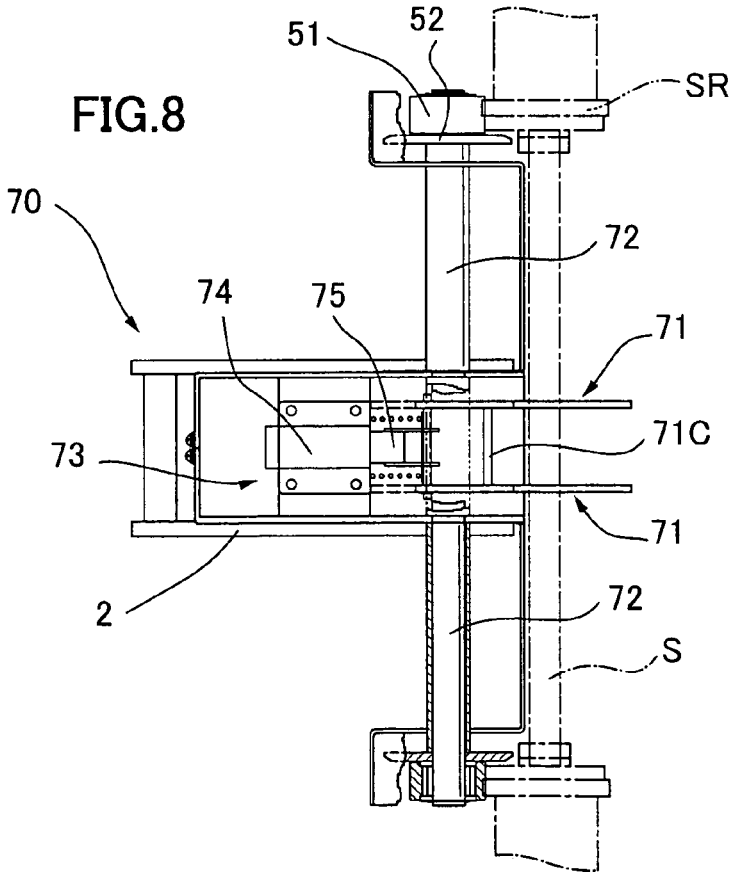
FIG. 8 is a partly enlarged plan view of the lift apparatus shown in FIG. 7.

Referring to FIGS. 7 and 8, there is shown a further alternative or third embodiment.

The third embodiment of the lift apparatus shown generally at 70 is different from the first and second embodiments of the lift apparatus of the present invention only in that the lift apparatus 70 additionally comprises a safety means for preventing inadvertent downward movement of the lift apparatus when the motor is inoperative or stopped, or in the event of failure of the motor. Accordingly, any further description of the same components as those of the first and second embodiments will be not repeated. In FIGS. 7 and 8, those parts corresponding to the components of the lift apparatus 1, 60 are identified with the same numerals as those used in conjunction with the first and second embodiments.

The safety means of the third embodiment of the lift apparatus 70 comprises a pair of hook members 71 and 71 spaced apart transversely and connected to each other by a connecting member 71C provided therebetween. Each of the hook members 71 and 71 includes a distal hooked portion 71A configured to be hooked over or engage the corresponding rung S of the ladder from above and a proximal pivotal connector portion 71B. A cross shaft 72 extends transversely and fixedly attached at opposite ends thereof to the lift frame 2 and is connected to the hook members 71, 71 between the distal and proximal portions 71A and 71B in such a manner to support the hook members 71 and 71 for pivotal movement.

The safety means has actuating means for providing pivotal movement of the hook members 71 and 71 around the cross shaft 72 between a engaged position wherein the hooked portion 71A of the each of the hook members can engage the corresponding rung S of the ladder and a disengaged position wherein the hook members 71 and 71 remain disengaged from the ladder when the motor is in operation. In FIG. 7, the hook member 71 is shown in solid line in the engaged position and in phantom line in the disengaged position.

In this embodiment, the actuating means is in the form of a solenoid-operated actuator device 73 which is adapted to be controlled by the controller 6. The actuator device 73 comprises an actuator housing 74 securely mounted on the lift frame 2 and a piston rod 75 adapted to be moved away from or toward the actuator housing 74 in response to a predetermined command provided by the controller 6. At its distal end the piston rod 75 is operatively associated with the pivotal connecting portion 71B of the hook members 71 and 71 via a shaft for pivotal movement of the hook members.

As the motor is stopped, the controller 6 is arranged so as to retract the piston rod 75 of the actuator 73 so that the pair of the hook members 71 can be moved to their engaged position.

The safety means additionally includes retainer means for retaining the hook member pair 71 in the disengaged position. The retainer means comprises a retaining shaft 76 extending widthwise inward of the lift apparatus 70 between the opposite sides of the hook members 71 and 71 and a latch member 77 operatively associated with the retaining shaft. The latch member 77 has a proximal end portion pivotally mounted on the frame 2 of the lift apparatus and a distal hooked end portion which can be engaged with the retainer shaft 76 when the hook members 71 and 71 are in the disengaged position.

With the arrangement of the lift apparatus 70 as described, it is assumed that the motor 4 is stopped either intentionally or inadvertently after the lift apparatus has been carried up to a certain level along the ladder by means of the motor 4. Then, the piston rod 75 is caused to be moved toward the actuator housing 74 so that the hook members 71 and 71 may be pivoted about the cross shaft 72 until they assume the engaged position. As a result, even if the lift apparatus 70 should begin to move downward due to a limited or smaller reduction gear rate of the reduction gearing or the like, the lift apparatus 70 can be prevented from inadvertently moving downwardly because the respective hooked end portions 71A of the hook members are brought into engagement with the corresponding rung S of the ladder. When the motor is not in service, the hook members 71 and 71 can manually pivotally moved from the engaged position to disengaged position, if necessary. Then, the hooked distal end portion of the retaining member 77 can be manually hooked over the retaining shaft 76 so as to hold the hook members 71 and 71 in the disengaged position.

Alternatively, the controller 6 may be configured in such a manner that the operator can operate the actuator 73 without resorting to any operational relationship between the actuator 73 and the motor 4 as described above.

As can be appreciated from the foregoing, the present invention provides the new and unique lift apparatus capable of climbing or descending the existing ladder being located upright in conjunction with a vertical surface and also enabling the operator to manually operate the lift apparatus in such a manner as to carry it up or down along the ladder in the event of failure thereof.

Although the present invention has been described with reference to a specific, preferred embodiment, those skilled in the art will recognize that various modifications and improvements can be made while remaining within the scope and spirit of the present invention. The scope of the present invention is determined solely by the appended claims.

For example, the cam 40 and in particular the lower face 44 thereof can be modified or re-shaped so as to provide for substantially the same motion of each of the gripper members 20 as the motion established by the combination of the auxiliary cam roller 36 and cam 45, thereby eliminating the auxiliary cam roller 36 and cam 45.

While in the several embodiments as illustrated and described, one pair of the endless chains 16 and 17 and two pairs of the endless chains 16 and 17, and 16' and 17' are employed, more than 2 pairs of the endless chains can be utilized.

Also, while in the illustrated embodiments, the mechanical arrangement of the gripping members and cam is used as the gripper mechanism for providing releasable engagement with the rungs of the ladder, the operation of each of the gripper, more specifically, the movement of the load supporting plates 28 relative to the endless chains 16 and 17, and 16' and 17' as well as the movement of the dogs relative to the load supporting plates 28 can controlled either electrically or electronically by use of means other than that as described, for example, the existing mechanism such as the motor and gearing so long as the releasable engagement with the ladder rungs as described may be attained.

Optionally, either of the illustrated embodiments 1, 60 and 70 of the lift apparatus according to the present invention can utilize means for providing a braking force for limiting the movement of the lift apparatus 1, 60 and 70 relative to the ladder. Such braking means comprises a braking force controlling device and a braking mechanism operatively connected to the controlling device for preventing the movement of the gripping members 20. The braking mechanism can be operatively associated with the motor 4 or may coupled with the second shafts 14 and 14'. The braking mechanism can be either of a disc brake or drum brake type. For example, in order to operate the braking mechanism it is possible to operatively connect the braking controlling device with the drum brake type mechanism through a wire. Alternatively, it is contemplated to provide a connection between the braking controlling device and the disc drum brake type mechanism via hydraulic fluid. Also, an electrical connection between the braking controlling device and the disc drum brake type mechanism is possible. In the case of the lift apparatus with the braking means thereon, the lift apparatus can be lowered along the ladder with the aid of the braking means, for example, in the event of failure of the motor 4, in particular when the motor cannot be run in the reverse direction. In this case, conveniently, the reduction gearing provides a small reduction gear ratio. Also, advantageously, as the lift apparatus approaches a target or desired level, for example in the region of the ground level, along the ladder during the downward movement thereof, the motor can be stopped and then the braking means can be manually operated so as to smoothly carry the lift apparatus at the target level, preferably with the motor remaining stopped.

What is claimed is:

1. A lift apparatus for use with a ladder having two spaced upright stringers and a plurality of horizontal rungs bridging the stringers and spaced at a distance vertically from one another, the lift apparatus comprising:

a frame;

a prime mover mounted on the frame and having a rotatable output shaft;

at least one pair of sprocket systems spaced apart vertically from each other, at least one of the sprocket systems being operatively coupled with the output shaft of the prime mover;

endless driving force transmitting means passing around the pair of the sprocket systems;

controller means for controlling the prime mover in such a manner as to selectively rotate the output shaft thereof in order to move the endless driving force transmitting means in a forward or reverse direction, or stop it;

gripper elements being carried by said endless driving force transmitting means and spaced at a distance substantially corresponding to that of the rungs of the ladder, said gripper elements engaging the horizontal rungs with said frame being moved up or down the ladder in correspondence with the movement of the endless driving force transmitting means; and a platform secured to the frame for supporting an operator thereon.

2. The lift apparatus as defined in claim 1, further comprising means for preventing the lift apparatus from moving downwardly along the ladder when the motor is rendered inoperative.

3. A lift apparatus for use with a ladder having two spaced upright stingers and a plurality of horizontal rungs bridging the stringers and spaced at a distance vertically from one another, the improvement comprising:

a frame;

a prime mover mounted on the frame and having a rotatable output shaft;

at least one pair of sprocket systems spaced apart vertically from each other, at least one of the sprocket systems being operatively coupled with the output shaft of the prime mover;

endless driving force transmitting means passing around the pair of the sprocket systems;

controller means for controlling the prime mover in such a manner as to selectively rotate the output shaft thereof in forward or reverse direction, or stop it;

an operating mechanism for causing a plurality of gripper elements to be engaged with the corresponding rungs of the ladder, said gripper elements being carried by said endless driving force transmitting means and spaced at a distance substantially corresponding to that of the rungs of a ladder; and a platform secured to the frame for supporting an operator thereon, wherein each of said gripper elements includes:

a load supporting plate including an recessed engaging portion capable of engaging the top surface of the rung and mounted for pivotal movement relative to said endless driving force transmitting means;

biasing means operable to pivot said load supporting plate relative to said endless driving force transmitting means in such a manner as to move the recessed portion thereof upwardly away from the top surface of the rung; and a cam follower attached to said load supporting plate; and wherein said operating mechanism comprises a cam operable to engage said cam follower as at least one of the gripper elements confronts the ladder so as to pivot said load supporting plate relative to said endless driving force transmitting means against a biasing force from said biasing means in order to place said recessed portion of the load supporting plate into engagement with the top of the rung of the ladder.

4. The lift apparatus as defined in claim 3 wherein each of said load supporting plate further includes a gripping finger pivotally attached thereto, said gripping finger being adapted to engage the side surface of the corresponding rung remote from the lift apparatus when each of the gripper elements confronts the ladder.

* * * * *